US009953591B1

(12) United States Patent
Holland et al.

(10) Patent No.: US 9,953,591 B1
(45) Date of Patent: Apr. 24, 2018

(54) MANAGING TWO DIMENSIONAL STRUCTURED NOISE WHEN DRIVING A DISPLAY WITH MULTIPLE DISPLAY PIPES

(71) Applicant: Apple Inc., Cupertino, CA (US)

(72) Inventors: Peter F. Holland, Los Gatos, CA (US); Brijesh Tripathi, Los Altos, CA (US); Hari Ganesh R. Thirunageswaram, Milpitas, CA (US)

(73) Assignee: Apple Inc., Cupertino, CA (US)

( * ) Notice: Subject to any disclaimer, the term of this patent is extended or adjusted under 35 U.S.C. 154(b) by 407 days.

(21) Appl. No.: 14/500,590

(22) Filed: Sep. 29, 2014

(51) Int. Cl.
*G09G 3/36* (2006.01)

(52) U.S. Cl.
CPC ..... *G09G 3/3607* (2013.01); *G09G 3/3611* (2013.01)

(58) Field of Classification Search
CPC ... H04N 9/12; H04N 9/31; H04B 1/66; G09G 5/02; G09G 3/007; G09G 3/34; G06T 15/00
See application file for complete search history.

(56) References Cited

U.S. PATENT DOCUMENTS 5,363,209 A 11/1994 Eschbach et al.
7,265,784 B1 9/2007 Frank
8,055,075 B1 11/2011 Tamura
8,351,739 B2 1/2013 Lee et al.
8,942,477 B2 1/2015 Tamura et al.
2006/0145975 A1* 7/2006 Kempf ..... G09G 3/007 345/84
2006/0182183 A1* 8/2006 Winger ..... H04N 19/61 375/240.27
2008/0024683 A1* 1/2008 Damera-Venkata . H04N 9/3147 348/744
2009/0115778 A1* 5/2009 Ford ..... G09G 5/363 345/419
2009/0267962 A1* 10/2009 Kim ..... G09G 3/2055 345/596
2011/0150332 A1 6/2011 Sibiryakov et al.
2014/0192267 A1 7/2014 Biswas et al.

FOREIGN PATENT DOCUMENTS

WO 2015084966 A2 6/2015

* cited by examiner

*Primary Examiner* — Lun-Yi Lao
*Assistant Examiner* — Johny Lau
(74) *Attorney, Agent, or Firm* — Rory D. Rankin; Meyertons, Hood, Kivlin, Kowert & Goetzel, P.C.

(57) ABSTRACT

Systems, apparatuses, and methods for driving a split display with multiple display pipelines. Frames for driving a display are logically divided into portions, a first display pipeline drives a first portion of the display, and a second display pipeline drives a second portion of the display. Each display pipeline generates dither noise for each frame in its entirety but only utilizes dither noise for the portion of the frame which is being driven to its respective portion of the display. This approach prevents visual artifacts from appearing at the dividing line between the first and second portions of the display.

20 Claims, 9 Drawing Sheets

MANAGING TWO DIMENSIONAL STRUCTURED NOISE WHEN DRIVING A DISPLAY WITH MULTIPLE DISPLAY PIPES

BACKGROUND

Technical Field

Embodiments described herein relate to the field of graphical information processing and more particularly, to generating noise for dithering when driving separate portions of an image frame to a divided display.

Description of the Related Art

Part of the operation of many computer systems, including portable digital devices such as mobile phones, notebook computers and the like, is to employ a display device, such as a liquid crystal display (LCD), to display images, video information/streams, and data. Accordingly, these systems typically incorporate functionality for generating images and data, including video information, which are subsequently output to the display device. Such devices typically include video graphics circuitry (i.e., a display pipeline) to process images and video information for subsequent display.

In digital imaging, the smallest item of information in an image is called a "picture element," more generally referred to as a "pixel." For convenience, pixels are generally arranged in a regular two-dimensional grid. By using such an arrangement, many common operations can be implemented by uniformly applying the same operation to each pixel independently. Since each pixel is an elemental part of a digital image, a greater number of pixels can provide a more accurate representation of the digital image. To represent a specific color on an electronic display, each pixel may have three values, one each for the amounts of red, green, and blue present in the desired color. Some formats for electronic displays may also include a fourth value, called alpha, which represents the transparency of the pixel. This format is commonly referred to as ARGB or RGBA. Another format for representing pixel color is YCbCr, where Y corresponds to the luma, or brightness, of a pixel and Cb and Cr correspond to two color-difference chrominance components, representing the blue-difference (Cb) and red-difference (Cr).

Most images and video information displayed on display devices such as LCD screens are interpreted as a succession of ordered image frames, or frames for short. While generally a frame is one of the many still images that make up a complete moving picture or video stream, a frame can also be interpreted more broadly as simply a still image displayed on a digital (discrete or progressive scan) display. A frame typically consists of a specified number of pixels according to the resolution of the image/video frame. Most graphics systems use memories (commonly referred to as "frame buffers") to store the pixels for image and video frame information. The information in a frame buffer typically consists of color values for every pixel to be displayed on the screen.

A constant interval between images allows a video stream or animated image to appear to move smoothly. Without a constant interval, movement of objects and people in the video stream would appear erratic and unnatural. Before the use of LCD displays and digital video standards became common, analog cathode ray tube televisions and monitors used a signal called the Vertical Blanking Interval (VBI) to re-position the electron gun from the bottom right corner of the screen back to the top left where each video frame began. The VBI signal has continued to be present in modern video systems even though its original purpose is obsolete, and it can provide a constant interval for updating image frames.

A display pipeline may be configured to support display resolutions up to a certain resolution. High resolution displays, such as displays having horizontal resolution on the order of 4000 pixels (or 4 k resolution), have become increasingly prevalent. A display pipeline designed for low resolution displays may be unable to support the pixel bandwidth required to display pixels on the screen for these high resolution displays. Additionally, in some cases, the frame refresh rate may be 120 hertz (Hz) or higher, increasing the amount of processing the display pipeline is required to perform per second.

In view of the above, methods and mechanisms for processing and driving pixels to high resolution displays are desired.

SUMMARY

Systems, apparatuses, and methods for generating noise for dithering when driving separate portions of an image frame to a divided display are contemplated.

In one embodiment, an apparatus may include multiple display pipelines. Each source frame of a sequence of source frames may be logically partitioned into a plurality of portions. The portions of the source frames may then be retrieved and processed by the display pipelines and presented on a respective display screen, which may be a high definition display. For example, in one embodiment, frames may be logically divided in half vertically, and a separate display pipeline may be utilized to drive each half. Accordingly, a first display pipeline may drive a first half of the screen and a second display pipeline may drive a second half of the screen, with a resultant single image or video frame being shown on the display. In this way, each display pipeline may be configured to perform only half of the overall pixel processing.

Additionally, each display pipeline may generate noise for dithering to apply to their respective half of the source image. In one embodiment, in order to accurately generate the dither noise for the whole screen, each display pipeline may generate the noise for the entire source image, and then the first display pipeline may utilize only the noise values that pertain to the first half of the screen, and the second display pipeline may utilize only the noise values that pertain to the second half of the screen.

These and other features and advantages will become apparent to those of ordinary skill in the art in view of the following detailed descriptions of the approaches presented herein.

BRIEF DESCRIPTION OF THE DRAWINGS

The above and further advantages of the methods and mechanisms may be better understood by referring to the following description in conjunction with the accompanying drawings, in which.

DETAILED DESCRIPTION OF EMBODIMENTS

Figure 1:
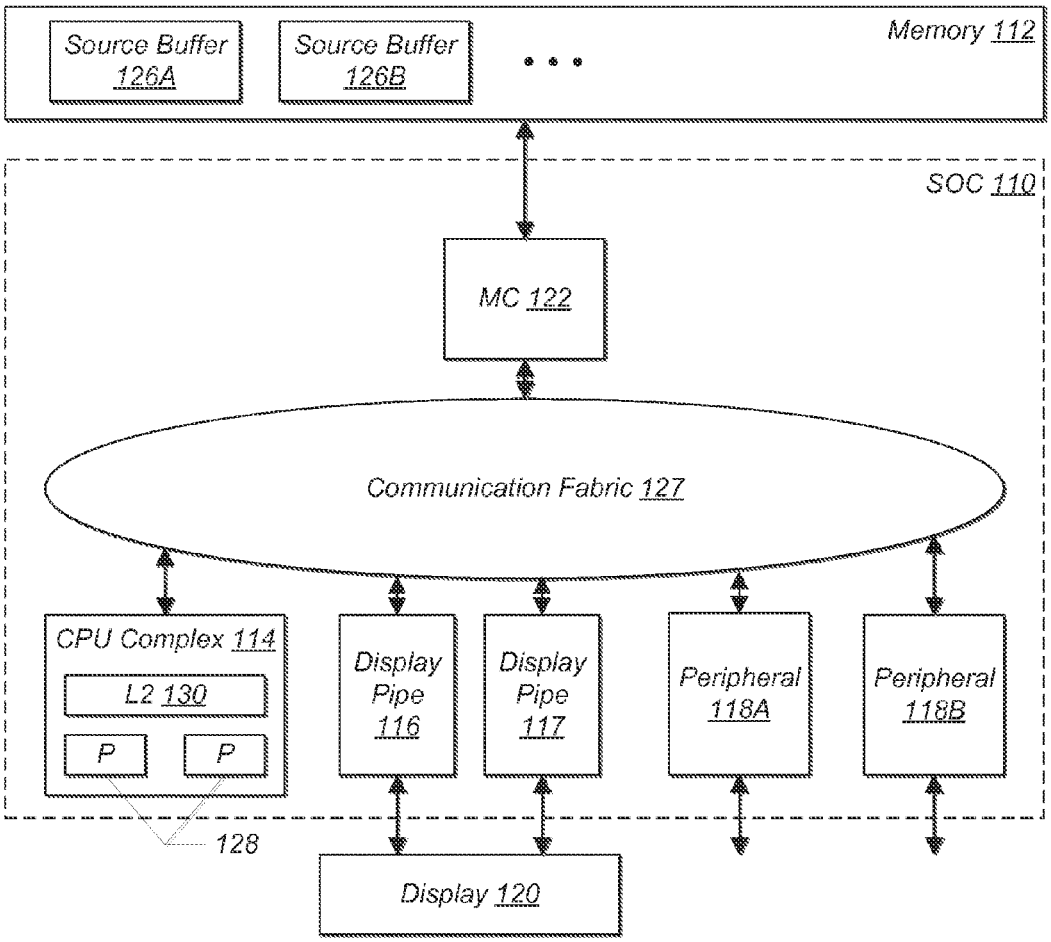
FIG. 1 is a block diagram illustrating one embodiment of a system on chip (SOC) coupled to a memory and one or more display devices.

In the following description, numerous specific details are set forth to provide a thorough understanding of the methods and mechanisms presented herein. However, one having ordinary skill in the art should recognize that the various embodiments may be practiced without these specific details. In some instances, well-known structures, components, signals, computer program instructions, and techniques have not been shown in detail to avoid obscuring the approaches described herein. It will be appreciated that for simplicity and clarity of illustration, elements shown in the figures have not necessarily been drawn to scale. For example, the dimensions of some of the elements may be exaggerated relative to other elements.

This specification includes references to "one embodiment". The appearance of the phrase "in one embodiment" in different contexts does not necessarily refer to the same embodiment. Particular features, structures, or characteristics may be combined in any suitable manner consistent with this disclosure. Furthermore, as used throughout this application, the word "may" is used in a permissive sense (i.e., meaning having the potential to), rather than the mandatory sense (i.e., meaning must). Similarly, the words "include", "including", and "includes" mean including, but not limited to.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "An apparatus comprising a display pipeline . . . ." Such a claim does not foreclose the apparatus from including additional components (e.g., a processor, a memory controller).

"Configured To." Various units, circuits, or other components may be described or claimed as "configured to" perform a task or tasks. In such contexts, "configured to" is used to connote structure by indicating that the units/circuits/components include structure (e.g., circuitry) that performs the task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. §112(f) for that unit/circuit/component. Additionally, "configured to" can include generic structure (e.g., generic circuitry) that is manipulated by software and/or firmware (e.g., an FPGA or a general-purpose processor executing software) to operate in a manner that is capable of performing the task(s) at issue. "Configured to" may also include adapting a manufacturing process (e.g., a semiconductor fabrication facility) to fabricate devices (e.g., integrated circuits) that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

Referring now to FIG. 1, a block diagram of one embodiment of a system on chip (SOC) 110 is shown coupled to a memory 112 and display device 120. A display device may be more briefly referred to herein as a display. As implied by the name, the components of the SOC 110 may be integrated onto a single semiconductor substrate as an integrated circuit "chip." In some embodiments, the components may be implemented on two or more discrete chips in a system. However, the SOC 110 will be used as an example herein. In the illustrated embodiment, the components of the SOC 110 include a central processing unit (CPU) complex 114, display pipes 116 and 117, peripheral components 118A-118B (more briefly, "peripherals"), a memory controller 122, and a communication fabric 127. The components 114, 116, 118A-118B, and 122 may all be coupled to the communication fabric 127. The memory controller 122 may be coupled to the memory 112 during use. Similarly, the display pipes 116 and 117 may be coupled to the display 120 during use. In the illustrated embodiment, the CPU complex 114 includes one or more processors 128 and a level two (L2) cache 130.

The display pipes 116 and 117 may include hardware to process one or more still images and/or one or more video sequences for display on the display 120. Generally, for each source still image or video sequence, the display pipes 116 and 117 may be configured to generate read memory operations to read the data representing respective portions of the frame/video sequence from the memory 112 through the memory controller 122.

The display pipes 116 and 117 may be configured to perform any type of processing on the image data (still images, video sequences, etc.). In one embodiment, the display pipes 116 and 117 may be configured to scale still images and to dither, scale, and/or perform color space conversion on their respective portions of frames of a video sequence. The display pipes 116 and 117 may be configured to blend the still image frames and the video sequence frames to produce output frames for display. Each of the display pipes 116 and 117 may also be more generally referred to as a display pipeline, display control unit, or a display controller. A display control unit may generally be any hardware configured to prepare a frame for display from one or more sources, such as still images and/or video sequences.

More particularly, each of the display pipes 116 and 117 may be configured to retrieve respective portions of source frames from one or more source buffers 126A-126B stored in the memory 112, composite frames from the source buffers, and display the resulting frames on corresponding portions of the display 120. Source buffers 126A and 126B are representative of any number of source frame buffers which may be stored in memory 112. Accordingly, display pipes 116 and 117 may be configured to read the multiple source buffers 126A-126B and composite the image data to generate the output frame.

The display 120 may be any sort of visual display device. The display 120 may be a liquid crystal display (LCD), light emitting diode (LED), plasma, cathode ray tube (CRT), etc. The display 120 may be integrated into a computing system including the SOC 110 (e.g. a smart phone or tablet) and/or may be a separately housed device such as a computer monitor, television, or other device.

In some embodiments, the display 120 may be directly connected to the SOC 110 and may be controlled by the display pipes 116 and 117. That is, the display pipes 116 and 117 may include hardware (a "backend") that may provide various control/data signals to the display, including timing signals such as one or more clocks and/or the vertical blanking period and horizontal blanking interval controls. The clocks may include the pixel clock indicating that a pixel is being transmitted. The data signals may include color signals such as red, green, and blue, for example. The display pipes 116 and 117 may control the display 120 in real-time or near real-time, providing the data indicating the pixels to be displayed as the display is displaying the image indicated by the frame. The interface to such display 120 may be, for example, VGA, HDMI, digital video interface (DVI), a liquid crystal display (LCD) interface, a plasma interface, a cathode ray tube (CRT) interface, any proprietary display interface, etc.

In one embodiment, each display pipeline 116 and 117 may be configured to operate independently of each other. In this embodiment, each display pipeline 116 and 117 may be configured to drive a separate display (although only one display is shown in FIG. 1). For example, in this embodiment, display pipeline 116 may be configured to drive a first display and display pipeline 117 may be configured to drive a second display. In another embodiment, the display 120 may be logically divided in half vertically. In this embodiment, display pipeline 116 may drive a first half of the screen, and display pipeline 117 may drive a second half of the screen. In this way, each display pipeline 116 and 117 may be configured to perform only half of the overall pixel processing. Software executing on processors 128 may be configured to program display pipelines 116 and 117 to operate according to the chosen embodiment. It is noted that in other embodiments, other numbers of display pipelines may be utilized in SOC 110 to drive a single display 120. For example, in another embodiment, four display pipelines may be utilized to drive a single display 120 which is logically partitioned into four portions.

The CPU complex 114 may include one or more CPU processors 128 that serve as the CPU of the SOC 110. The CPU of the system includes the processor(s) that execute the main control software of the system, such as an operating system. Generally, software executed by the CPU during use may control the other components of the system to realize the desired functionality of the system. The CPU processors 128 may also execute other software, such as application programs. The application programs may provide user functionality, and may rely on the operating system for lower level device control. Accordingly, the CPU processors 128 may also be referred to as application processors. The CPU complex may further include other hardware such as the L2 cache 130 and/or an interface to the other components of the system (e.g., an interface to the communication fabric 127).

The peripherals 118A-118B may be any set of additional hardware functionality included in the SOC 110. For example, the peripherals 118A-118B may include video peripherals such as video encoder/decoders, image signal processors for image sensor data such as camera, scalers, rotators, blenders, graphics processing units, etc. The peripherals 118A-118B may include audio peripherals such as microphones, speakers, interfaces to microphones and speakers, audio processors, digital signal processors, mixers, etc. The peripherals 118A-118B may include interface controllers for various interfaces external to the SOC 110 including interfaces such as Universal Serial Bus (USB), peripheral component interconnect (PCI) including PCI Express (PCIe), serial and parallel ports, etc. The peripherals 118A-118B may include networking peripherals such as media access controllers (MACs). Any set of hardware may be included.

The memory controller 122 may generally include the circuitry for receiving memory operations from the other components of the SOC 110 and for accessing the memory 112 to complete the memory operations. The memory controller 122 may be configured to access any type of memory 112. For example, the memory 112 may be static random access memory (SRAM), dynamic RAM (DRAM) such as synchronous DRAM (SDRAM) including double data rate (DDR, DDR2, DDR3, etc.) DRAM. Low power/mobile versions of the DDR DRAM may be supported (e.g. LPDDR, mDDR, etc.). The memory controller 122 may include various queues for buffering memory operations, data for the operations, etc., and the circuitry to sequence the operations and access the memory 112 according to the interface defined for the memory 112.

The communication fabric 127 may be any communication interconnect and protocol for communicating among the components of the SOC 110. The communication fabric 127 may be bus-based, including shared bus configurations, cross bar configurations, and hierarchical buses with bridges. The communication fabric 127 may also be packet-based, and may be hierarchical with bridges, cross bar, point-to-point, or other interconnects.

It is noted that the number of components of the SOC 110 (and the number of subcomponents for those shown in FIG. 1, such as within the CPU complex 114) may vary from embodiment to embodiment. There may be more or fewer of each component/subcomponent than the number shown in FIG. 1. It is also noted that SOC 110 may include many other components not shown in FIG. 1. In various embodiments, SOC 110 may also be referred to as an integrated circuit (IC), an application specific integrated circuit (ASIC), or an apparatus.

Figure 2:
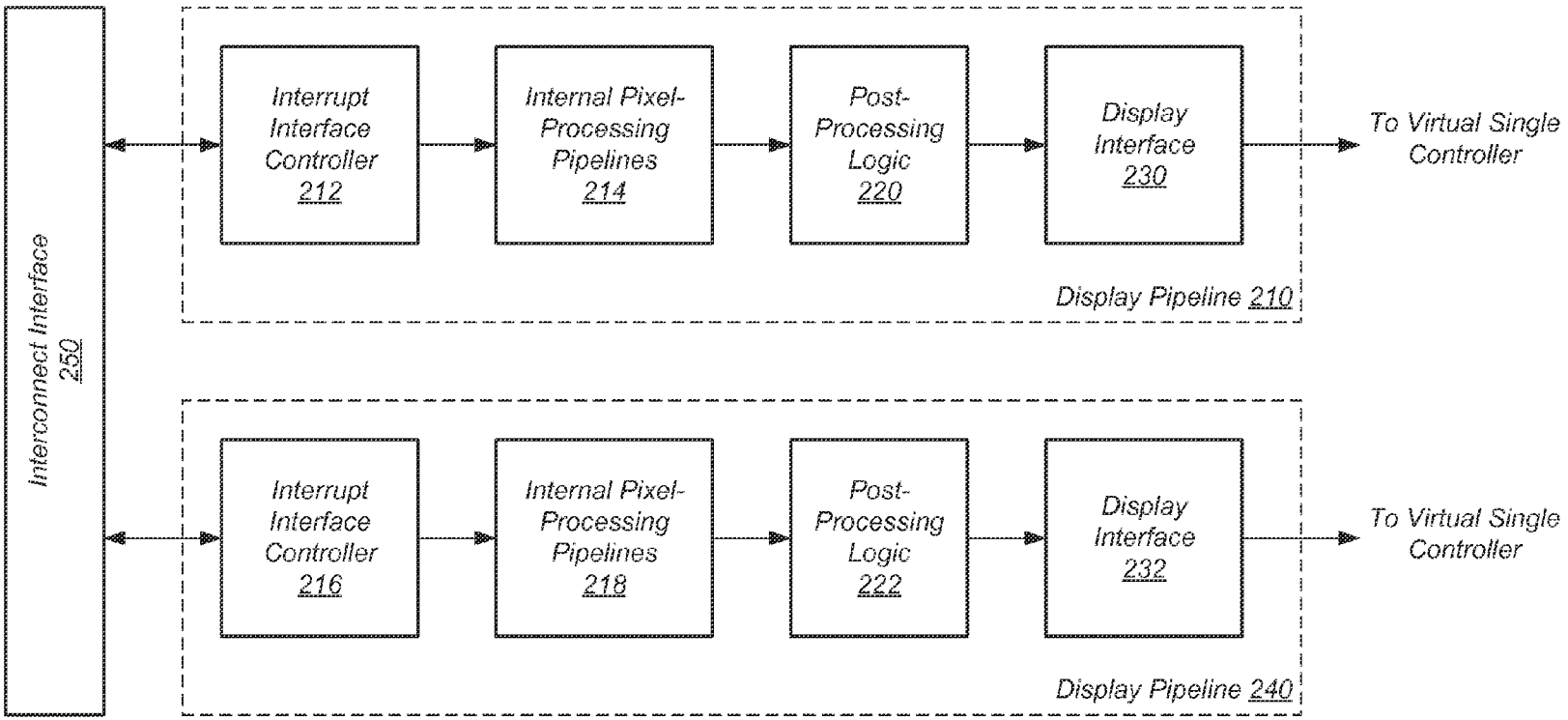
FIG. 2 is a block diagram of one embodiment of dual display pipelines for use in a SOC.

Turning now to FIG. 2, a generalized block diagram of one embodiment of dual display pipelines for use in a SOC is shown. The two display pipelines 210 and 240 may be coupled to interconnect interface 250. Although two display pipelines are shown, in other embodiments, the host SOC (e.g., SOC 110) may include another number of display pipelines. Each of the display pipelines may be configured to process half of a source frame and display the resultant half of the destination frame on the corresponding half of the display (not shown).

In one embodiment, display pipelines 210 and 240 may send rendered graphical information to the display via a virtual single controller (e.g., virtual single controller 1000 of FIG. 10). The interconnect interface 250 may include multiplexers and control logic for routing signals and packets between the display pipelines 210 and 240 and a top-level fabric. The interconnect interface 250 may correspond to communication fabric 127 of FIG. 1.

Display pipelines 210 and 240 may include interrupt interface controllers 212 and 216, respectively. The interrupt interface controllers 212 and 216 may include logic to expand a number of sources or external devices to generate interrupts to be presented to the internal pixel-processing pipelines 214 and 218, respectively. The controllers 212 and 216 may provide encoding schemes, registers for storing interrupt vector addresses, and control logic for checking, enabling, and acknowledging interrupts. The number of interrupts and a selected protocol may be configurable.

Display pipelines 210 and 240 may include one or more internal pixel-processing pipelines 214 and 218, respectively. The internal pixel-processing pipelines 214 and 218 may include one or more ARGB (Alpha, Red, Green, Blue) pipelines for processing and displaying user interface (UI) layers. The internal pixel-processing pipelines 214 and 218 may also include one or more pipelines for processing and displaying video content such as YUV content. The internal pixel-processing pipelines 214 and 218 may include logic for generating dither noise to apply to source image pixels. The generation of dither noise is described in further detail below. In some embodiments, internal pixel-processing pipelines 214 and 218 may include blending circuitry for blending graphical information before sending the information as output to post-processing logic 220 and 222, respectively.

The display pipelines 210 and 240 may include post-processing logic 220 and 222, respectively. The post-processing logic 220 may be used for color management, ambient-adaptive pixel (AAP) modification, dynamic backlight control (DPB), panel gamma correction, and dither. The display interfaces 230 and 232 may handle the protocol for communicating with the internal panel display. For example, the Mobile Industry Processor Interface (MIPI) Display Serial Interface (DSI) specification may be used. Alternatively, a 4-lane Embedded Display Port (eDP) specification may be used. The post-processing logic and display interface may also be referred to as the display backend.

Figure 3:
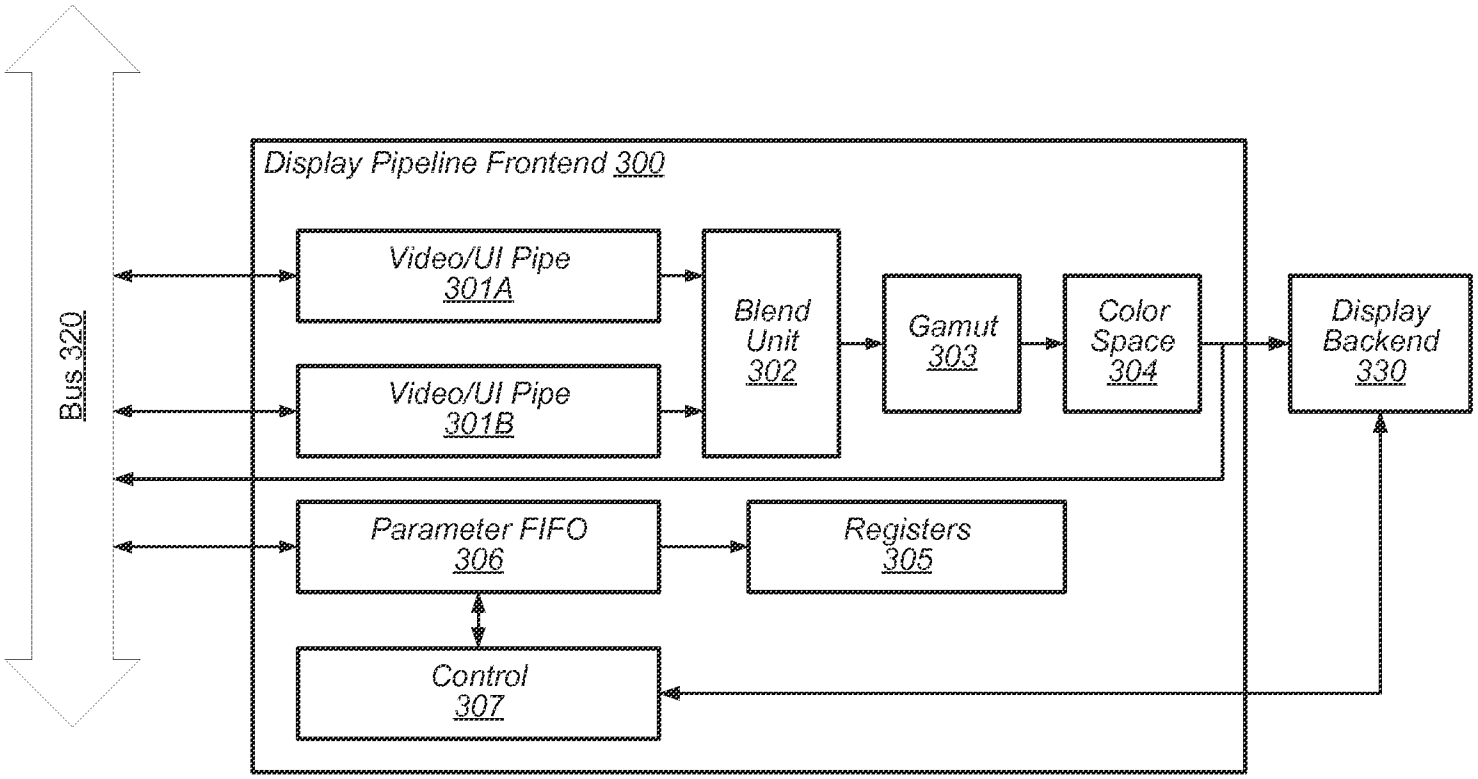
FIG. 3 is a block diagram illustrating one embodiment of a display pipeline frontend.

Referring now to FIG. 3, a block diagram of one embodiment of a display pipeline frontend 300 is shown. Display pipeline frontend 300 may represent the frontend portion of display pipes 116 and 117 of FIG. 1. Display pipeline frontend 300 may be coupled to a system bus 320 and to a display backend 330. In some embodiments, display backend 330 may directly interface to the display to display pixels generated by display pipeline frontend 300. Display pipeline frontend 300 may include functional sub-blocks such as one or more video/user interface (UI) pipelines 301A-B, blend unit 302, gamut adjustment block 303, color space converter 304, registers 305, parameter First-In First-Out buffer (FIFO) 306, and control unit 307. Display pipeline frontend 300 may also include other components which are not shown in FIG. 3 to avoid cluttering the figure.

System bus 320, in some embodiments, may correspond to communication fabric 127 from FIG. 1. System bus 320 couples various functional blocks such that the functional blocks may pass data between one another. Display pipeline frontend 300 may be coupled to system bus 320 in order to receive video frame data for processing. In some embodiments, display pipeline frontend 300 may also send processed video frames to other functional blocks and/or memory that may also be coupled to system bus 320. It is to be understood that when the term "video frame" is used, this is intended to represent any type of frame, such as an image, that can be rendered to the display.

The display pipeline frontend 300 may include one or more video/UI pipelines 301A-B, each of which may be a video and/or user interface (UI) pipeline depending on the embodiment. It is noted that the terms "video/UI pipeline" and "pixel processing pipeline" may be used interchangeably herein. In other embodiments, display pipeline frontend 300 may have one or more dedicated video pipelines and/or one or more dedicated UI pipelines. Each video/UI pipeline 301 may fetch a source image (or a portion of a source image) from a buffer coupled to system bus 320. The buffered source image may reside in a system memory such as, for example, system memory 112 from FIG. 1. Each video/UI pipeline 301 may fetch a distinct source image (or a portion of a distinct source image) and may process the source image in various ways, including, but not limited to, format conversion (e.g., YCbCr to ARGB), image scaling, and dithering. In some embodiments, each video/UI pipeline may process one pixel at a time, in a specific order from the source image, outputting a stream of pixel data, and maintaining the same order as pixel data passes through.

In one embodiment, when utilized as a user interface pipeline, a given video/UI pipeline 301 may support programmable active regions in the source image. The active regions may define the only portions of the source image to be displayed. In an embodiment, the given video/UI pipeline 301 may be configured to only fetch data within the active regions. Outside of the active regions, dummy data with an alpha value of zero may be passed as the pixel data.

Control unit 307 may, in various embodiments, be configured to arbitrate read requests to fetch data from memory from video/UI pipelines 301A-B. In some embodiments, the read requests may point to a virtual address. A memory management unit (not shown) may convert the virtual address to a physical address in memory prior to the requests being presented to the memory. In some embodiments, control unit 307 may include a dedicated state machine or sequential logic circuit. A general purpose processor executing program instructions stored in memory may, in other embodiments, be employed to perform the functions of control unit 307.

Blending unit 302 may receive a pixel stream from one or more of video/UI pipelines 301A-B. If only one pixel stream is received, blending unit 302 may simply pass the stream through to the next sub-block. However, if more than one pixel stream is received, blending unit 302 may blend the pixel colors together to create an image to be displayed. In various embodiments, blending unit 302 may be used to transition from one image to another or to display a notification window on top of an active application window. For example, a top layer video frame for a notification, such as, for a calendar reminder, may need to appear on top of, i.e., as a primary element in the display, despite a different application, an internet browser window for example. The calendar reminder may comprise some transparent or semi-transparent elements in which the browser window may be at least partially visible, which may require blending unit 302 to adjust the appearance of the browser window based on the color and transparency of the calendar reminder. The output of blending unit 302 may be a single pixel stream composite of the one or more input pixel streams.

The output of blending unit 302 may be sent to gamut adjustment unit 303. Gamut adjustment 303 may adjust the color mapping of the output of blending unit 302 to better match the available color of the intended target display. The output of gamut adjustment unit 303 may be sent to color space converter 304. Color space converter 304 may take the pixel stream output from gamut adjustment unit 303 and convert it to a new color space. Color space converter 304 may then send the pixel stream to display backend 330 or back onto system bus 320. In other embodiments, the pixel stream may be sent to other target destinations. For example, the pixel stream may be sent to a network interface for example. In some embodiments, a new color space may be chosen based on the mix of colors after blending and gamut corrections have been applied. In further embodiments, the color space may be changed based on the intended target display.

Display backend 330 may control the display to display the pixels generated by display pipeline frontend 300. Display backend 330 may read pixels at a regular rate from an output FIFO (not shown) of display pipeline frontend 300 according to a pixel clock. The rate may depend on the resolution of the display as well as the refresh rate of the display. For example, a display having a resolution of N×M and a refresh rate of R frames per second may have a pixel clock frequency based on N×M×R. On the other hand, the output FIFO may be written to as pixels are generated by display pipeline frontend 300.

Display backend 330 may receive processed image data as each pixel is processed by display pipeline frontend 300. Display backend 330 may provide final processing to the image data before each video frame is displayed. In some embodiments, display back end may include ambient-adaptive pixel (AAP) modification, dynamic backlight control (DPB), display panel gamma correction, and dithering specific to an electronic display coupled to display backend 330.

The parameters that display pipeline frontend 300 may use to control how the various sub-blocks manipulate the video frame may be stored in control registers 305. These registers may include, but are not limited to, setting input and output frame sizes, setting input and output pixel formats, location of the source frames, and destination of the output (display backend 330 or system bus 320). Control registers 305 may be loaded by parameter FIFO 306.

Parameter FIFO 306 may be loaded by a host processor, a direct memory access unit, a graphics processing unit, or any other suitable processor within the computing system. In other embodiments, parameter FIFO 306 may directly fetch values from a system memory, such as, for example, system memory 112 in FIG. 1. Parameter FIFO 306 may be configured to update control registers 305 of display processor 300 before each source video frame is fetched. In some embodiments, parameter FIFO may update all control registers 305 for each frame. In other embodiments, parameter FIFO may be configured to update subsets of control registers 305 including all or none for each frame. A FIFO as used and described herein, may refer to a memory storage buffer in which data stored in the buffer is read in the same order it was written. A FIFO may be comprised of RAM or registers and may utilize pointers to the first and last entries in the FIFO.

While processing a given source video frame, control unit 307 may determine if the configuration data needed for processing the next source video frame has already been received. The configuration data may be referred to as a "frame packet" for the purposes of this discussion. Control unit 307 may be configured to send an indication to display backend 330 when the next frame packet corresponding to the next source video frame has been received by parameter FIFO 306.

It is noted that the display pipeline frontend 300 illustrated in FIG. 3 is merely an example. In other embodiments, different functional blocks and different configurations of functional blocks may be possible depending on the specific application for which the display pipeline is intended. For example, more than two video/UI pipelines may be included within a display pipeline frontend in other embodiments.

Figure 4:
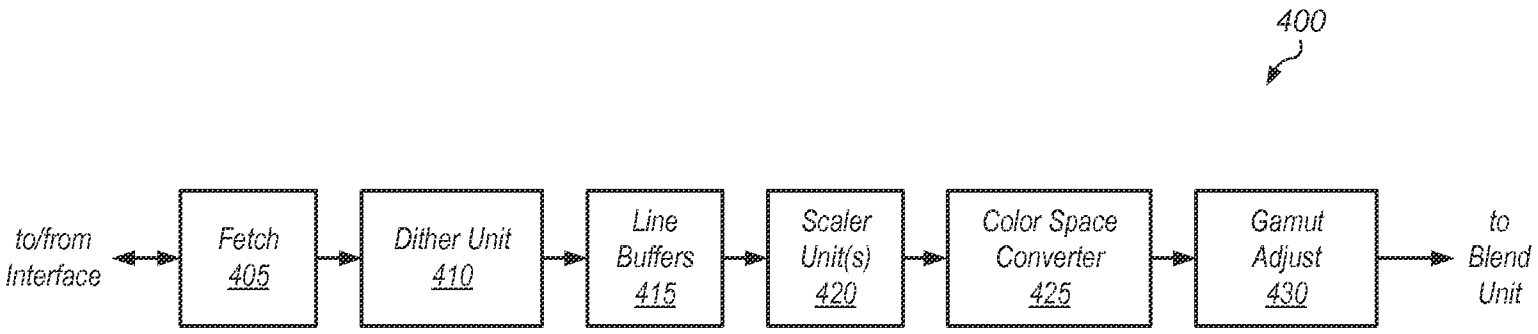
FIG. 4 is a block diagram illustrating one embodiment of a video/UI pipeline.

Turning now to FIG. 4, a block diagram of one embodiment of a video/UI pipeline 400 is shown. Video/UI pipeline 400 may correspond to video/UI pipelines 301A and 301B of display pipeline 300 as illustrated in FIG. 3. In the illustrated embodiment, video/UI pipeline 400 includes fetch unit 405, dither unit 410, line buffers 415, scaler unit(s) 420, color space converter 425, and gamut adjust unit 430. In general, video/UI pipeline 400 may be responsible for fetching pixel data for source frames stored in a memory, and then processing the fetched data before sending the processed data to a blend unit, such as, blend unit 302 of display pipeline frontend 300 as illustrated in FIG. 3.

Fetch unit 405 may be configured to generate read requests for source pixel data needed by the requestor(s) of video/UI pipeline 400. Fetching the source lines from the source buffer is commonly referred to as a "pass" of the source buffer. During each pass of the source buffer, required portions or blocks of data may be fetched from top to bottom, then from left to right, where "top," "bottom," "left," and "right" are in reference to a display. In other embodiments, passes of the source buffer may proceed differently.

Each read request may include one or more addresses indicating where the portion of data is stored in memory. In some embodiments, address information included in the read requests may be directed towards a virtual (also referred to herein as "logical") address space, wherein addresses do not directly point to physical locations within a memory device. In such cases, the virtual addresses may be mapped to physical addresses before the read requests are sent to the source buffer. A memory management unit may, in some embodiments, be used to map the virtual addresses to physical addresses. In some embodiments, the memory management unit may be included within the display pipeline frontend, while in other embodiments, the memory management unit may be located elsewhere within a computing system.

Under certain circumstances, the total number of colors that a given system is able to generate or manage within the given color space—in which graphics processing takes place—may be limited. In such cases, a technique called dithering is used to create the illusion of color depth in the images that have a limited color palette. In a dithered image, colors that are not available are approximated by a diffusion of colored pixels from within the available colors. Dithering in image and video processing is also used to prevent large-scale patterns, including stepwise rendering of smooth gradations in brightness or hue in the image/video frames, by intentionally applying a form of noise to randomize quantization error. Dither unit 410 may, in various embodiments, provide structured noise dithering on the Luma channel of YCbCr formatted data. Other channels, such as the chroma channels of YCbCr, and other formats, such as ARGB may not be dithered. In various embodiments, dither unit 410 may apply a two-dimensional array of Gaussian noise (i.e., statistical noise that is normally distributed) to blocks of the source frame data. A block of source frame data may, in some embodiments, include one or more source pixels. The noise may be applied to raw source data fetched from memory prior to scaling.

In one embodiment, a random noise generator (RNG) implemented using a Linear Feedback Shift Register (LFSR) may produce pseudo random numbers that are injected into the display pipe as dither-noise. The dither unit 410 may be operated to seed the RNG with a same unique non-zero seed for a same given video image frame. In another embodiment, dither unit 410 may utilize a LFSR to generate coordinates for selecting and applying a randomly selected region of a two-dimensional noise array to a source image region of the Luma channel. In other embodiments, dither unit 410 may utilize other suitable techniques for injecting dither noise into the display pipe.

In one embodiment, while fetch unit 405 may fetch only a portion of the source image for a split-display scenario, dither unit 410 may be configured to generate dither-noise for the source frame in its entirety. Dither unit 410 may then use only the generated dither-noise for the corresponding portion of the source image fetched by fetch unit 405. Dither unit 410 may discard the generated dither-noise that does not apply to this corresponding portion of the source image. For example, in one embodiment, fetch unit 405 may fetch the left half of the source image, and dither unit 410 may utilize only the dither-noise that applies to the left half of the source image while not using the dither-noise that applies to the right half of the source image. If a frame is repeated, then the LFSR may be re-initialized to the initial value of the original frame to ensure that dithering does not change while the content is unchanged.

Line buffers 415 may be configured to store the incoming frame data corresponding to row lines of a respective display screen. The frame data may be indicative of luminance and chrominance of individual pixels included within the row lines. Line buffers 415 may be designed in accordance with one of various design styles. For example, line buffers 415 may be SRAM, DRAM, or any other suitable memory type. In some embodiments, line buffers 415 may include a single input/output port, while, in other embodiments, line buffers 415 may have multiple data input/output ports.

In some embodiments, scaling of source pixels may be performed in two steps. The first step may perform a vertical scaling, and the second step may perform a horizontal scaling. In the illustrated embodiment, scaler unit(s) 420 may perform the vertical and horizontal scaling. Scaler unit(s) 420 may be designed according to one of varying design styles. In some embodiments, the vertical scaler and horizontal scaler of scaler unit(s) 420 may be implemented as 9-tap 32-phase filters. These multi-phase filters may, in various embodiments, multiply each pixel retrieved by fetch unit 405 by a weighting factor. The resultant pixel values may then be added, and then rounded to form a scaled pixel. The selection of pixels to be used in the scaling process may be a function of a portion of a scale position value. In some embodiments, the weighting factors may be stored in a programmable table, and the selection of the weighting factors to use in the scaling may be a function of a different portion of the scale position value.

In some embodiments, the scale position value (also referred to herein as the "display position value"), may included multiple portions. For example, the scale position value may include an integer portion and a fractional portion. In some embodiments, the determination of which pixels to scale may depend on the integer portion of the scale position value, and the selecting of weighting factors may depend on the fractional portion of the scale position value. In some embodiments, a Digital Differential Analyzer (DDA) may be used to determine the scale position value.

Color management within video/UI pipeline 400 may be performed by color space converter 425 and gamut adjust unit 430. In some embodiments, color space converter 425 may be configured to convert YCbCr source data to the RGB format. Alternatively, color space converter may be configured to remove offsets from source data in the RGB format. Color space converter 425 may, in various embodiments, include a variety of functional blocks, such as an input offset unit, a matrix multiplier, and an output offset unit (all not shown). The use of such blocks may allow the conversion from YCbCr format to RGB format and vice-versa.

In various embodiments, gamut adjust unit 430 may be configured to convert pixels from a non-linear color space to a linear color space, and vice-versa. In some embodiments, gamut adjust unit 430 may include a Look Up Table (LUT) and an interpolation unit. The LUT may, in some embodiments, be programmable and be designed according to one of various design styles. For example, the LUT may include a SRAM or DRAM, or any other suitable memory circuit. In some embodiments, multiple LUTs may be employed. For example, separate LUTs may be used for Gamma and De-Gamma calculations.

It is note that the embodiment illustrated in FIG. 4 is merely an example. In other embodiments, different functional blocks and different configurations of functional blocks may be utilized.

Figure 5:
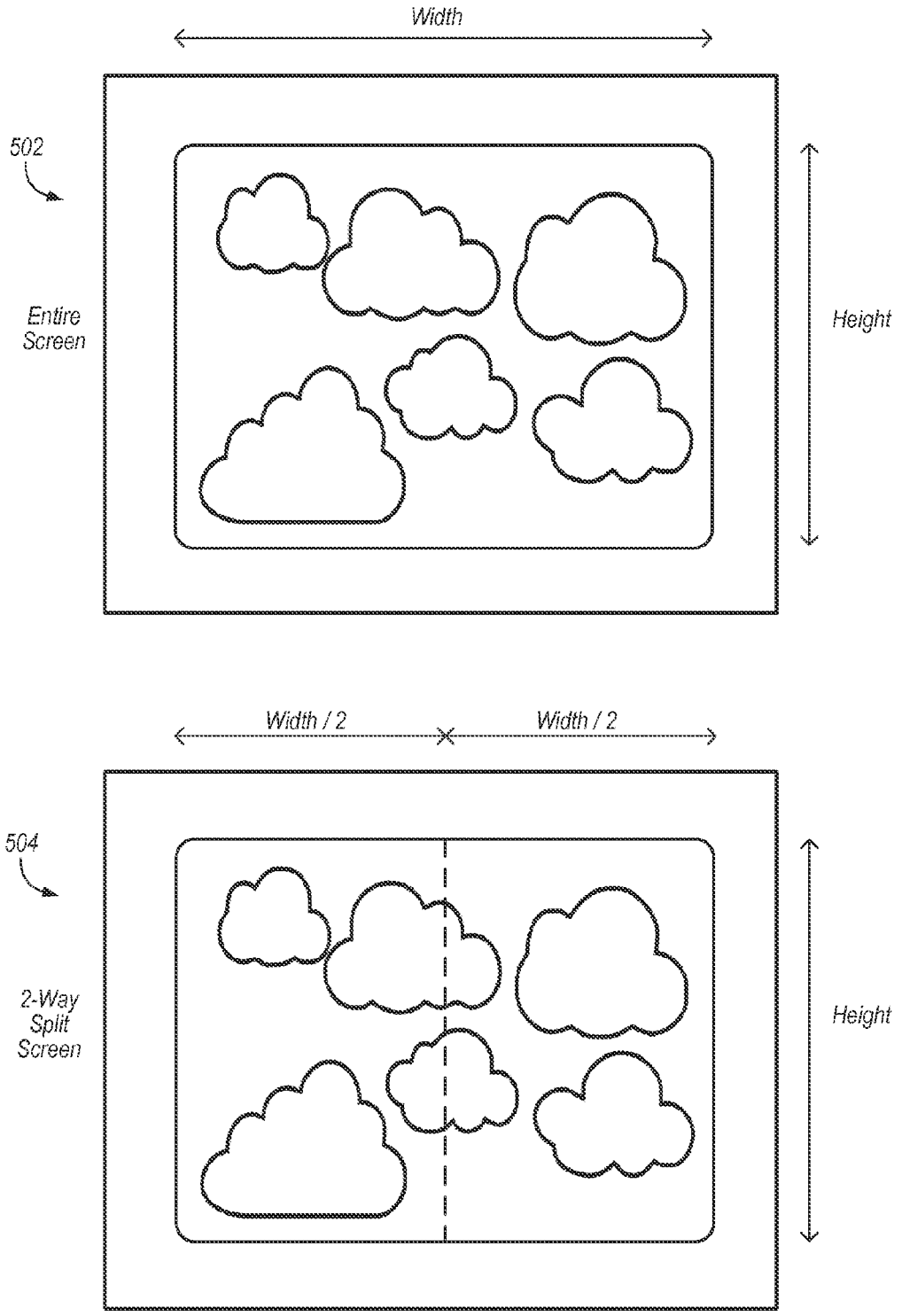
FIG. 5 is a block diagram illustrating a non-split display screen and a two-way split display screen.

Referring now to FIG. 5, a block diagram of a non-split display screen and a two-way split display screen is shown. Screen 502 is shown at the top of FIG. 5, and screen 502 represents the scenario where a screen is not logically partitioned. In contrast, screen 504 is the same size as screen 502, but screen 504 is logically partitioned into two portions. The partitioning may be performed by splitting the screen into the left half and the right half, with the partitioning occurring down the middle from top to bottom of the screen. In other embodiments, the screen may be partitioned differently and/or into more than two portions. For example, in another embodiment, the screen may be partitioned horizontally into a top half and bottom half.

In one embodiment, an entire video frame may be displayed on screen 504 using two display pipelines and appear the same as the entire video frame being displayed on screen 502 using a single display pipeline. The video frame is shown as a cluster of clouds in screens 502 and 504 to illustrate an example of a frame from the scene of a television show, movie, or other sequence of images. The difference for screen 504 (as compared to screen 502) is that a first display pipeline would be driving the left side of the video frame to the display and a second display pipeline would be driving the right side of the video frame to the display. The first display pipeline would continue driving the left side of the video frame and the second display pipeline would continue driving the right side of the video frame to screen 504 for each video frame in the sequence of video frames corresponding to a video being displayed on screen 504. In contrast, a single display pipeline would be driving the entire video frame to the display for screen 502 for each video frame in the sequence of video frames.

Figure 6:
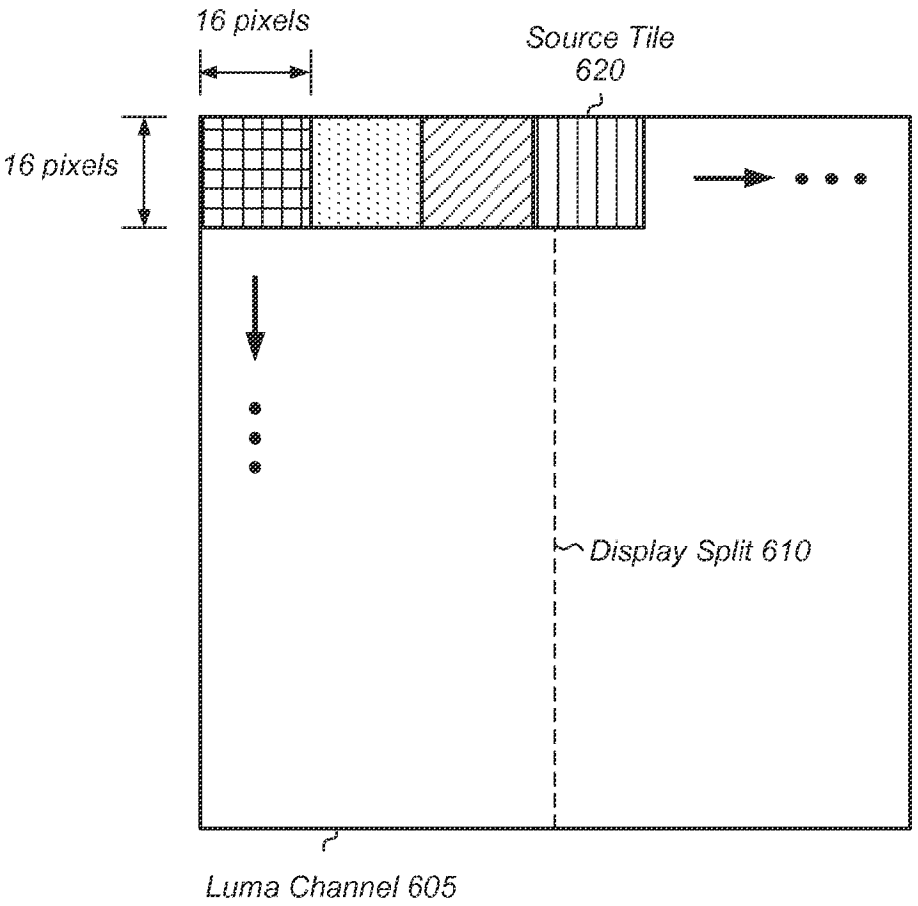
FIG. 6 is a diagram illustrating techniques for generating two dimensional (2D) structured noise for dithering.
Figure 6:
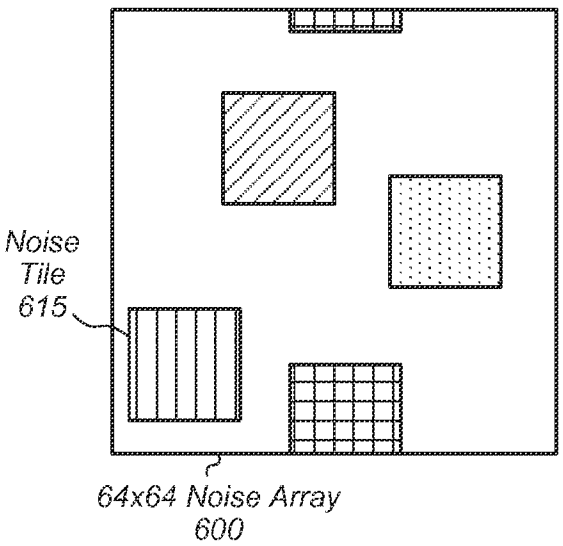

Turning now to FIG. 6, a block diagram of one embodiment of an example of generating two dimensional (2D) structured noise for dithering is shown. Each display pipe (e.g., display pipes 210 and 240 of FIG. 2) may include a dither unit (e.g., dither unit 410 of FIG. 4) to generate 2D structured noise (or 2DSN) for dithering the luma channel of YCbCr sources. The term "2D structured noise" refers to noise that is organized on a 2D plane. In one embodiment, software executing on the SoC (e.g., SoC 110 of FIG. 1) may generate a 2D array of Gaussian noise which is then applied in blocks to the source image by the dither unit.

In one embodiment, software may populate a 64 by 64 array with noise coefficients. This 64 by 64 array may be referred to as the "noise array". The pre-programmed noise array 600 may then be loaded into the display pipes via register writes or parameter FIFO packets. It is noted that in other embodiments, other sizes of noise arrays may be utilized. Also, in other embodiments, the dither unit may be configured to populate the noise array 600 with noise coefficients. Each display pipeline of a plurality of display pipelines may be configured to generate an index into noise array 600 to select noise for dithering a respective portion of a source frame.

In one embodiment, the dither unit may apply a pseudo-randomly selected 16×16, 32×32, or 64×64 region of 2DSN from the noise array 600 to an equally sized source image pixel block of the luma channel 605. Noise coefficients may be sampled from a 16×16, 32×32, or 64×64 subsection (or noise tile) of noise array 600. Any starting X,Y location may be supported, and noise tiles may wrap around noise array 600 horizontally and/or vertically. In one embodiment, the X and Y coordinates of the noise tile may be generated by a pseudo-random number generator implemented using a linear feedback shift register (LFSR). The bit-length of the polynomial used to construct the LFSR may vary according to the embodiment. It is noted that in other embodiments, other sizes of regions may be selected from the noise array other than just 16×16, 32×32, or 64×64 sized regions.

In one embodiment, the LFSR in each display pipe may be initialized at reset to a default seed value set by software. Thereafter, each LFSR may be re-initialized to a programmable seed value at the beginning of a new frame or allowed to run freely across multiple frames without re-initialization. However, if a frame is repeated, then the LFSR may be re-initialized to the initial value of the original frame to ensure that the dithering does not change while the content is unchanged.

In one embodiment, the dither unit may apply noise by dividing the luma channel 605 of the source image into source tiles of the same size (i.e., 16×16 pixels) as the noise tiles starting from the upper-left corner of the source image. Each source tile of luma channel 605 may have a pseudo-randomly chosen noise tile applied to it pixel by pixel. In other words, the noise coefficient from coordinate (x,y) within the noise tile is applied to the luma value at coordinate (x,y) of the source tile. In some embodiments, before being applied to the corresponding luma value, the noise coefficient may be scaled by one or more programmable scaling factor values.

The display split 610 shown in luma channel 605 represents the dividing line between the left (or first) portion of luma channel 605 and the right (or second) portion of luma channel 605. In one embodiment, a first display pipeline may dither pixels of the left portion of luma channel 605 while a second display pipeline may dither pixels of the right portion of luma channel 605. Each display pipeline may utilize the same noise array 600, and each display pipeline may also utilize a LFSR initialized to the same seed value. Therefore, the first display pipeline may apply noise values from noise tile 615 to pixels to the left of display split 610 for source tile 620 while the second display pipeline applies noise values from noise tile 615 to pixels to the right of display split 610 for source tile 620. This approach may be followed for other source tiles that straddle the display split 610 of luma channel 605.

Figure 7:
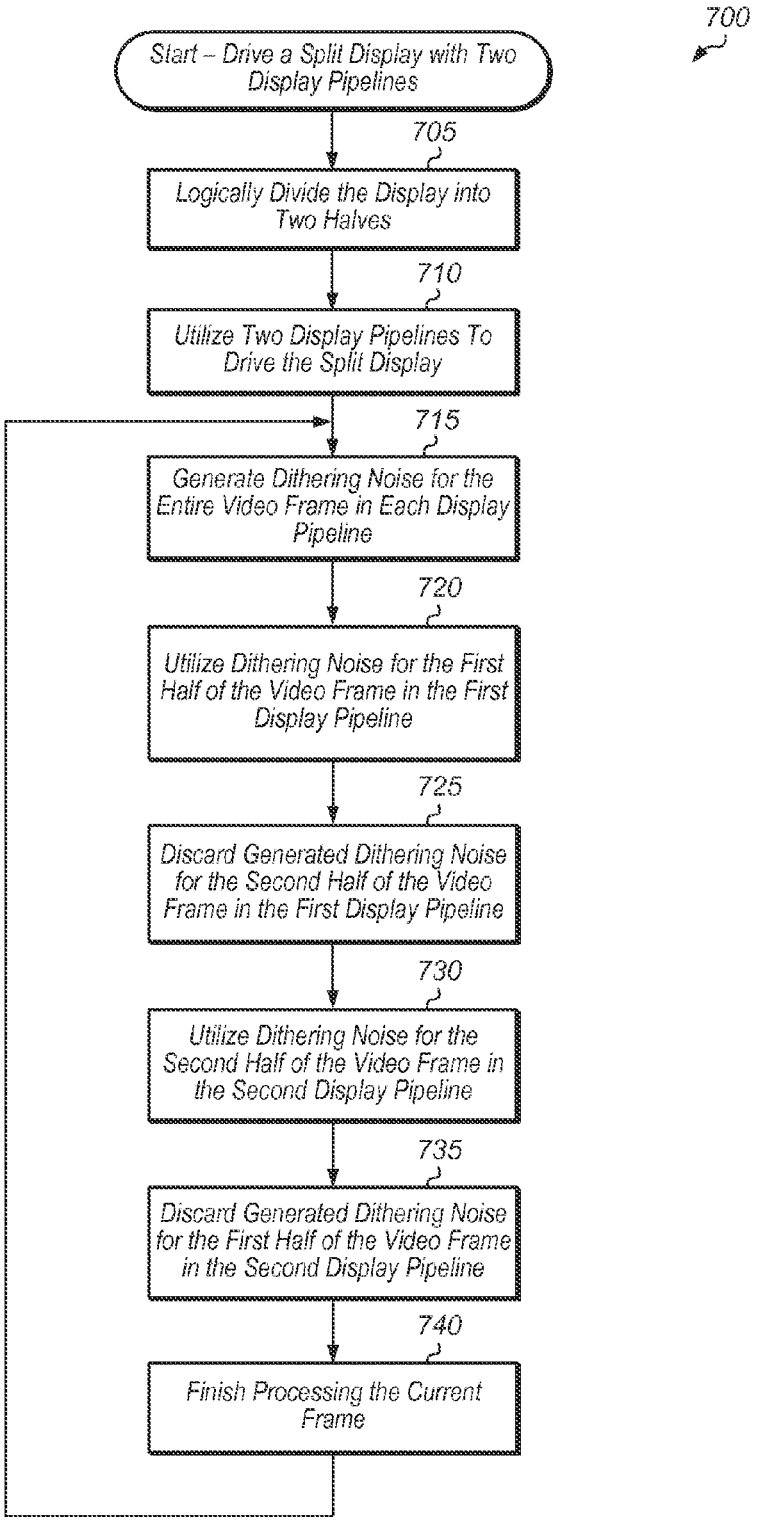
FIG. 7 is a generalized flow diagram illustrating one embodiment of a method for driving a split display with two display pipelines.

Referring now to FIG. 7, one embodiment of a method 700 for driving a split display with two display pipelines is shown. For purposes of discussion, the steps in this embodiment are shown in sequential order. It should be noted that in various embodiments of the method described below, one or more of the elements described may be performed concurrently, in a different order than shown, or may be omitted entirely. Other additional elements may also be performed as desired. Any of the various devices and display pipelines described herein may be configured to implement method 700.

A display may be logically divided into two halves (block 705). In one embodiment, the display may be a high definition display such as a 4 k resolution display. Additionally, in some embodiments, the display may be refreshed at a frame rate of 120 Hz or higher. Two display pipelines may be utilized to drive the split display (block 710). Accordingly, a first display pipeline may drive a first half of the display and a second display pipeline may drive a second half of the display.

In each display pipeline, when processing a video frame, dither noise may be generated for the entire video frame (block 715). Then, the first display pipeline may utilize dither noise corresponding to the first half of the video frame (block 720). Also, the first display pipeline may discard the generated dither noise corresponding to the second half of the video frame (block 725). Similarly, the second display pipeline may utilize dither noise corresponding to the second half of the video frame (block 730). Also, the second display pipeline may discard the generated dither noise corresponding to the first half of the video frame (block 735). For both display pipelines, after finishing processing of the current frame (block 740), method 700 may return to block 715 to process the next video frame.

Figure 8:
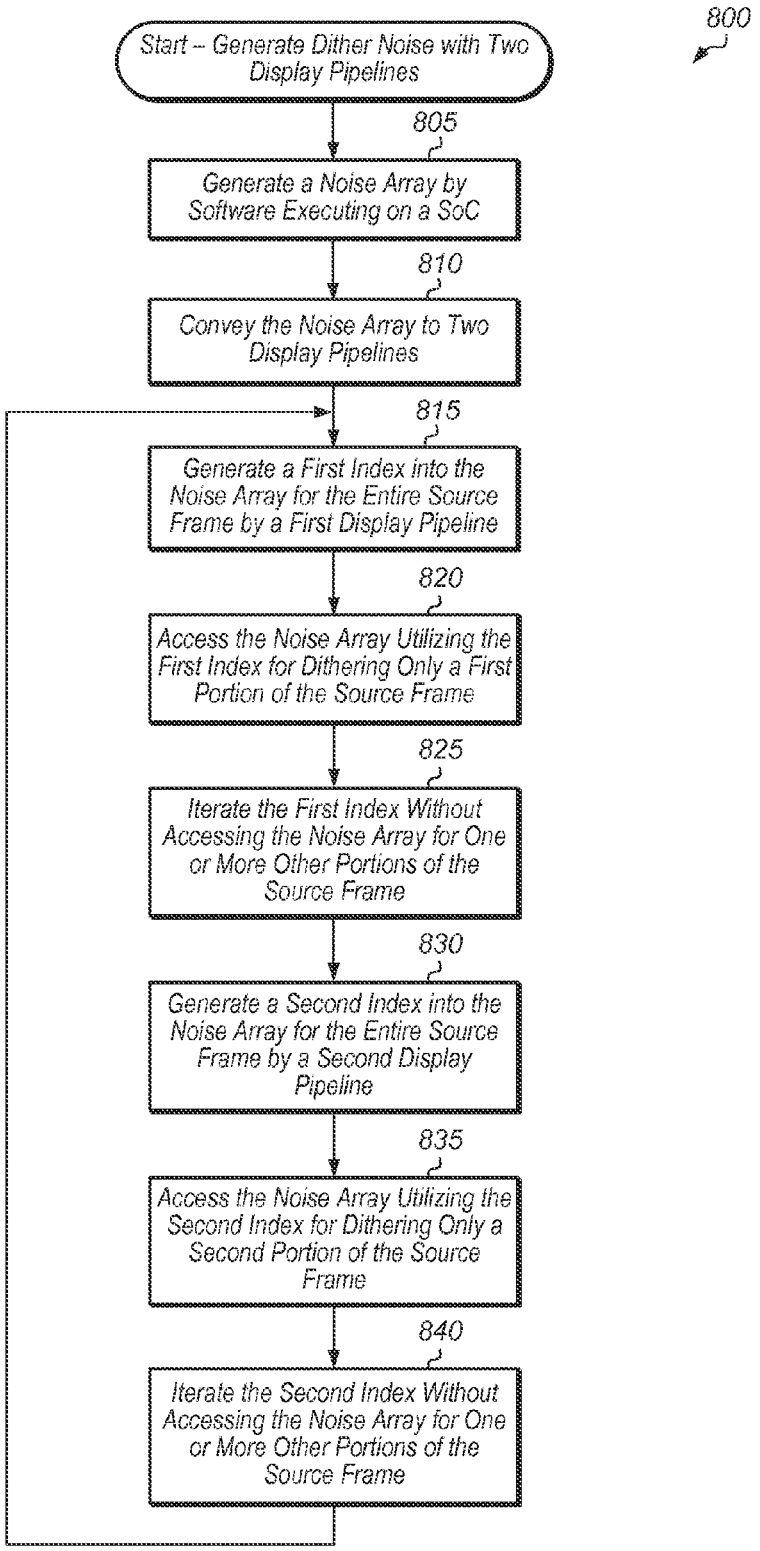
FIG. 8 is a generalized flow diagram illustrating one embodiment of a method for generating dither noise with two display pipelines.

Turning now to FIG. 8, one embodiment of a method 800 for generating dither noise with two display pipelines is shown. For purposes of discussion, the steps in this embodiment are shown in sequential order. It should be noted that in various embodiments of the method described below, one or more of the elements described may be performed concurrently, in a different order than shown, or may be omitted entirely. Other additional elements may also be performed as desired. Any of the various devices and display pipelines described herein may be configured to implement method 800.

A noise array may be generated by software executing on a SoC (block 805). The noise array may be conveyed to two display pipelines (block 810). Alternatively, in another embodiment, each display pipeline may be configured to generate the same noise array. In a further embodiment, a first display pipeline may be configured to generate a noise array and convey the noise array to one or more other display pipelines.

A first display pipeline may utilize a mechanism to generate a first index into the noise array for the entire source frame (block 815). In one embodiment, the mechanism may be a linear feedback shift register (LFSR). The first display pipeline may access the noise array, utilizing the first index, for dithering only a first portion of the source frame (block 820). The first display pipeline may iterate the first index without accessing the noise array for one or more other portions of the source frame (block 825).

A second display pipeline may utilize a mechanism to generate a second index into the noise array for the entire source frame (block 830). The noise array utilized by the second display pipeline may be an exact copy of the noise array utilized by the first display pipeline. The second display pipeline may access the noise array, utilizing the second index, for dithering only a second portion of the source frame (block 835). The second display pipeline may iterate the second index without accessing the noise array for one or more other portions of the source frame (block 840). It is noted that each iteration of the first index may be equal to a corresponding iteration of the second index for the source frame in its entirety. After block 840, method 800 may return to block 815 to process the next source frame. It is noted that although method 800 is described as being performed by two display pipelines, the same techniques described for method 800 may be used in embodiments with more than two display pipelines with each display pipeline driving a separate portion of the display.

In one embodiment, each display pipeline may be configured to utilize the same type of LFSR, and each LFSR may be initialized to the same value. Each LFSR may be utilized to generate noise array coordinates for the entire source frame, but the display pipeline may only use the coordinates to access the noise array for its respective portion of the source frame. Since each LFSR is initialized to the same value, the LFSR's in different pipelines will generate the same coordinates for the entire source frame.

Figure 9:
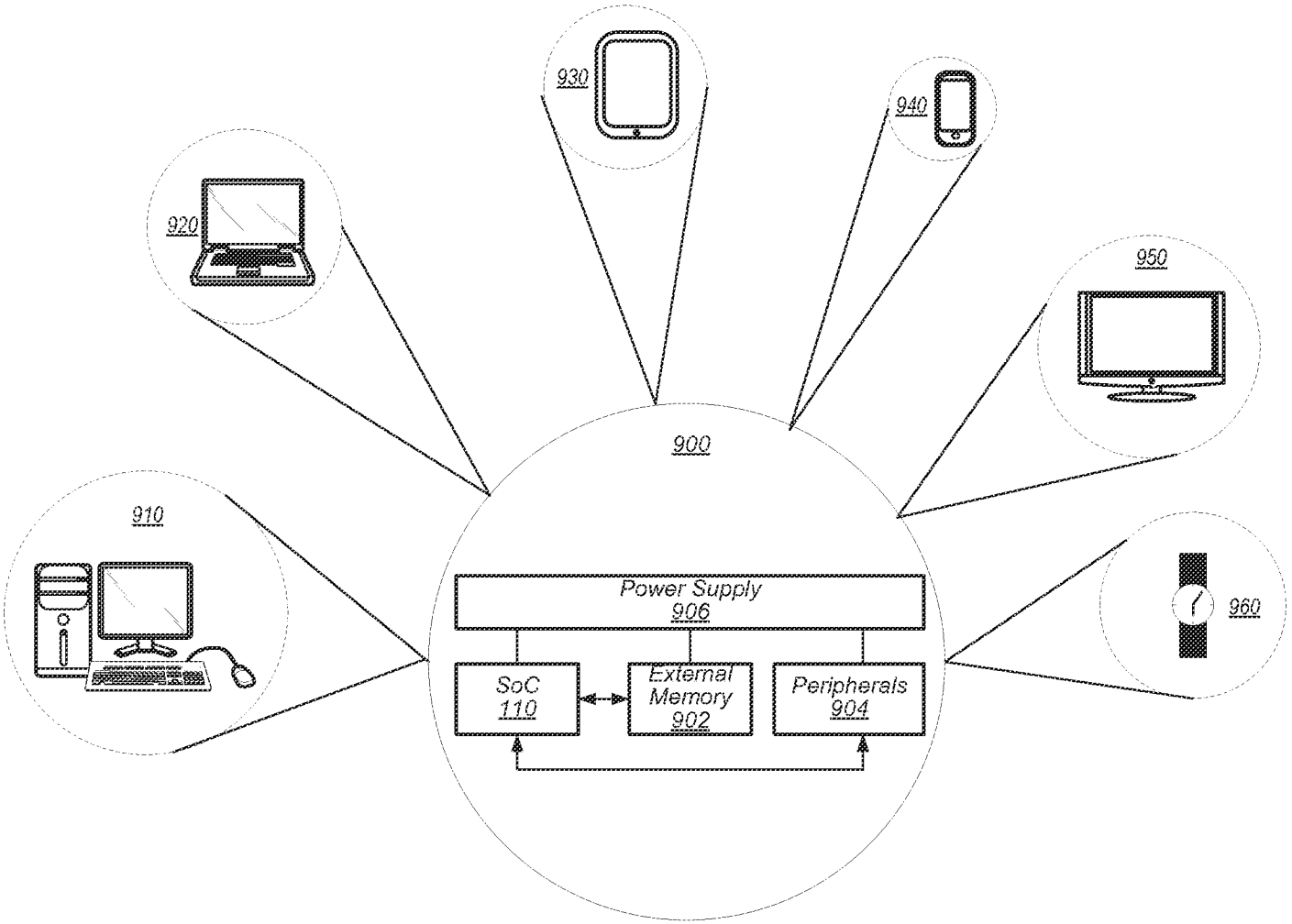
FIG. 9 is a block diagram of one embodiment of a system.

Referring next to FIG. 9, a block diagram of one embodiment of a system 900 is shown. As shown, system 900 may represent chip, circuitry, components, etc., of a desktop computer 910, laptop computer 920, tablet computer 930, cell phone 940, television 950 (or set top box configured to be coupled to a television), wrist watch or other wearable item 960, or otherwise. Other devices are possible and are contemplated. In the illustrated embodiment, the system 900 includes at least one instance of SoC 110 (of FIG. 1) coupled to an external memory 902.

SoC 110 is coupled to one or more peripherals 904 and the external memory 902. A power supply 906 is also provided which supplies the supply voltages to SoC 110 as well as one or more supply voltages to the memory 902 and/or the peripherals 904. In various embodiments, power supply 906 may represent a battery (e.g., a rechargeable battery in a smart phone, laptop or tablet computer). In some embodiments, more than one instance of SoC 110 may be included (and more than one external memory 902 may be included as well).

The memory 902 may be any type of memory, such as dynamic random access memory (DRAM), synchronous DRAM (SDRAM), double data rate (DDR, DDR2, DDR3, etc.) SDRAM (including mobile versions of the SDRAMs such as mDDR3, etc., and/or low power versions of the SDRAMs such as LPDDR2, etc.), RAMBUS DRAM (RDRAM), static RAM (SRAM), etc. One or more memory devices may be coupled onto a circuit board to form memory modules such as single inline memory modules (SIMMs), dual inline memory modules (DIMMs), etc. Alternatively, the devices may be mounted with SoC 110 in a chip-on-chip configuration, a package-on-package configuration, or a multi-chip module configuration.

The peripherals 904 may include any desired circuitry, depending on the type of system 900. For example, in one embodiment, peripherals 904 may include devices for various types of wireless communication, such as wifi, Bluetooth, cellular, global positioning system, etc. The peripherals 904 may also include additional storage, including RAM storage, solid state storage, or disk storage. The peripherals 904 may include user interface devices such as a display screen, including touch display screens or multitouch display screens, keyboard or other input devices, microphones, speakers, etc.

In various embodiments, program instructions of a software application may be used to implement the methods and/or mechanisms previously described. The program instructions may describe the behavior of hardware in a high-level programming language, such as C. Alternatively, a hardware design language (HDL) may be used, such as Verilog. The program instructions may be stored on a non-transitory computer readable storage medium. Numerous types of storage media are available. The storage medium may be accessible by a computer during use to provide the program instructions and accompanying data to the computer for program execution. In some embodiments, a synthesis tool reads the program instructions in order to produce a netlist comprising a list of gates from a synthesis library.

It should be emphasized that the above-described embodiments are only non-limiting examples of implementations. Numerous variations and modifications will become apparent to those skilled in the art once the above disclosure is fully appreciated. It is intended that the following claims be interpreted to embrace all such variations and modifications.

What is claimed is:

1. An apparatus comprising:

a first display pipeline configured to:

generate dither noise for an entire source frame;

use only a portion of the dither noise generated by the first display pipeline for a first portion of the source frame, wherein the first portion of the source frame is less than the entire source frame;

discard an unused portion of the dither noise generated by the first display pipeline;

process the first portion of the source frame to generate a first portion of a destination frame; and drive the first portion of the destination frame to a corresponding portion of a display;

a second display pipeline, separate from the first display pipeline, configured to:

generate dither noise for the entire source frame;

use only a portion of the dither noise generated by the second display pipeline for a second portion of the source frame, wherein the second portion is different from the first portion and is less than the entire source frame;

discard an unused portion of the dither noise generated by the second display pipeline;

process the second portion of the source frame to generate a second portion of the destination frame; and drive the second portion of the destination frame to a corresponding portion of the display.

2. The apparatus as recited in claim 1, wherein a first display pipeline of the plurality of display pipelines is configured to:

generate a first index into a noise array for the source frame in its entirety;

access the noise array, utilizing the first index, for dithering only the first portion of the source frame; and iterate the first index without accessing the noise array for one or more other portions of the source frame.

3. The apparatus as recited in claim 2, wherein a second display pipeline of the plurality of display pipelines is configured to:

generate a second index into a noise array for the source frame in its entirety;

access the noise array, utilizing the second index, for dithering only the second portion of the source frame; and iterate the second index without accessing the noise array for one or more other portions of the source frame.

4. The apparatus as recited in claim 3, wherein the first index is equal to the second index for the source frame in its entirety.

5. The apparatus as recited in claim 1, wherein the dither noise is two-dimensional structured noise organized on a two-dimensional plane.

6. The apparatus as recited in claim 5, wherein each display pipeline of the plurality of display pipelines is further configured to apply randomly selected regions of a noise array to equal sized regions of the corresponding portion of the source frame.

7. The apparatus as recited in claim 6, wherein each display pipeline of the plurality of display pipelines is further configured to utilize a linear feedback shift register to generate coordinates of the randomly selected regions of the noise array to apply to the equal sized regions of the corresponding portion of the source frame.

8. A computing system comprising:

a display logically partitioned into a plurality of portions;

a first display pipeline configured to drive a first portion of a source frame to a first portion of the display, wherein the first portion of the source frame is less than the entire source frame;

a second display pipeline, separate from the first display pipeline, configured to drive a second portion of the source frame to the display, wherein the second portion is different from the first portion and is less than the entire source frame;

wherein the first display pipeline is configured to:

generate dither noise for the entire source frame;

use only a portion of the dither noise generated by the first display pipeline for the first portion of the source frame;

discard an unused portion of the dither noise generated by the first display pipeline;

process the first portion of the source frame to generate a first portion of a destination frame; and drive the first portion of the destination frame to a corresponding portion of a display;

wherein the second display pipeline is configured to:

generate dither noise for the entire source frame;

use only a portion of the dither noise generated by the second display pipeline for the second portion of the source frame;

discard an unused portion of the dither noise generated by the second display pipeline;

process the second portion of the source frame to generate a second portion of the destination frame; and drive the second portion of the destination frame to a corresponding portion of the display.

9. The computing system as recited in claim 8, wherein a first display pipeline of the plurality of display pipelines is configured to:

generate a first index into a noise array for the source frame in its entirety;

access the noise array, utilizing the first index, for dithering only the first portion of the source frame; and iterate the first index without accessing the noise array for one or more other portions of the source frame.

10. The computing system as recited in claim 9, wherein a second display pipeline of the plurality of display pipelines is configured to:

generate a second index into a noise array for the source frame in its entirety;

access the noise array, utilizing the second index, for only the second portion of the source frame; and iterate the second index without accessing the noise array for one or more other portions of the source frame.

11. The computing system as recited in claim 10, wherein the first index is equal to the second index for the source frame in its entirety.

12. The computing system as recited in claim 8, wherein the dither noise is two-dimensional structured noise organized on a two-dimensional plane.

13. The computing system as recited in claim 12, wherein each display pipeline of the plurality of display pipelines is further configured to apply randomly selected regions of a noise array to equal sized regions of the corresponding portion of the source frame.

14. The computing system as recited in claim 13, wherein each display pipeline of the plurality of display pipelines is further configured to utilize a linear feedback shift register to generate coordinates of the randomly selected regions of the noise array to apply to the equal sized regions of the corresponding portion of the source frame.

15. A method comprising:

a first display pipeline:

generating dither noise for an entire source frame;

using only a portion of the dither noise generated by the first display pipeline for a first portion of the source frame, wherein the first portion of the source frame is less than the entire source frame;

discarding an unused portion of the dither noise generated by the first display pipeline;

processing the first portion of the source frame to generate a first portion of a destination frame; and driving the first portion of the destination frame to a corresponding portion of a display;

a second display pipeline separate from the first display pipeline:

generating dither noise for the entire source frame;

using only a portion of the dither noise generated by the second display pipeline for a second portion of the source frame wherein the second portion is different from the first portion and is less than the entire source frame;

discarding an unused portion of the dither noise generated by the second display pipeline;

processing the second portion of the source frame to generate a second portion of the destination frame; and driving the second portion of the destination frame to a corresponding portion of the display.

16. The method as recited in claim 15, further comprising:

generating a first index into a noise array for the source frame in its entirety;

accessing the noise array, utilizing the first index, for dithering only the first portion of the source frame; and iterating the first index without accessing the noise array for one or more other portions of the source frame.

17. The method as recited in claim 16, further comprising:

generating a second index into a noise array for the source frame in its entirety;

accessing the noise array, utilizing the second index, for only the second portion of the source frame; and iterating the second index without accessing the noise array for one or more other portions of the source frame.

18. The method as recited in claim 17, wherein the first index is equal to the second index for the source frame in its entirety.

19. The method as recited in claim 15, wherein the dither noise is two-dimensional structured noise organized on a two-dimensional plane.

20. The method as recited in claim 19, further comprising applying randomly selected regions of a noise array to equal sized regions of the corresponding portion of the source frame.

* * * * *